US007823236B2

(12) United States Patent
Cerruti

(10) Patent No.: US 7,823,236 B2
(45) Date of Patent: Nov. 2, 2010

(54) ACTUATION DEVICE AND METHOD

(75) Inventor: Daniele Cerruti, Fontanetto Po (Vercelli) (IT)

(73) Assignee: Eltek S.p.A, Casale Monferrato (Alessandria) (IT)

( * ) Notice: Subject to any disclaimer, the term of this patent is extended or adjusted under 35 U.S.C. 154(b) by 460 days.

(21) Appl. No.: 11/997,863

(22) PCT Filed: Aug. 3, 2006

(86) PCT No.: PCT/IB2006/002202

§ 371 (c)(1),
(2), (4) Date: Feb. 4, 2008

(87) PCT Pub. No.: WO2007/017749

PCT Pub. Date: Feb. 15, 2007

(65) Prior Publication Data

US 2008/0223166 A1 Sep. 18, 2008

(30) Foreign Application Priority Data

Aug. 5, 2005 (IT) ..... TO2005A0555

(51) Int. Cl.
*D06F 37/28* (2006.01)

(52) U.S. Cl. ..... 8/147; 134/57 DL; 134/58 DL; 68/12.26

(58) Field of Classification Search ..... 68/12.26; 134/58 DL, 57 DL
See application file for complete search history.

(56) References Cited

U.S. PATENT DOCUMENTS 2,729,089 A * 1/1956 Pelcin ..... 70/151 R
2,759,347 A * 8/1956 Abresch ..... 68/21
4,613,176 A * 9/1986 Kelly ..... 292/201
5,271,253 A * 12/1993 Cassada et al. ..... 70/276
2004/0020517 A1 2/2004 Cerruti et al.

FOREIGN PATENT DOCUMENTS

EP 0 602 572 A1 6/1994
FR 2 489 858 A1 3/1982
FR 2 596 778 A1 10/1987

(Continued)

OTHER PUBLICATIONS

International Search Report from corresponding International Application No. PCT/IB2006/002202, completed Nov. 7, 2006.

(Continued)

*Primary Examiner*—Frankie L Stinson
(74) *Attorney, Agent, or Firm*—Heslin Rothenberg Farley & Mesiti P.C.; Victor A. Cardona, Esq.

(57) ABSTRACT

An actuation device comprises a driving member, a driven member and an actuator device. The driven member has a seat, in which there is operatively inserted, with possibility of relative movement, an engagement part of the driving member. According to the invention also the driving member has a seat, which, in at least one position of the actuation system, at least partially faces the seat of the driven member. The actuation system further comprises a floating body, displaceable in a controlled way between the two seats when said seats at least partially face one another.

21 Claims, 14 Drawing Sheets

FOREIGN PATENT DOCUMENTS

| | | | | |
|---|---|---|---|---|
| FR | 2 697 543 | A1 | | 5/1994 |
| GB | 2 188 704 | A | | 10/1987 |
| JP | 2000-137937 | | * | 5/2000 |
| KR | 2003069368 | | * | 8/2003 |
| SE | 452 248 | B | | 11/1987 |
| WO | WO 01/73182 | A2 | | 10/2001 |

OTHER PUBLICATIONS

Written Opinion from corresponding International Application No. PCT/IB2006/002202, mailed on Nov. 15, 2006.

* cited by examiner

Fig. 1
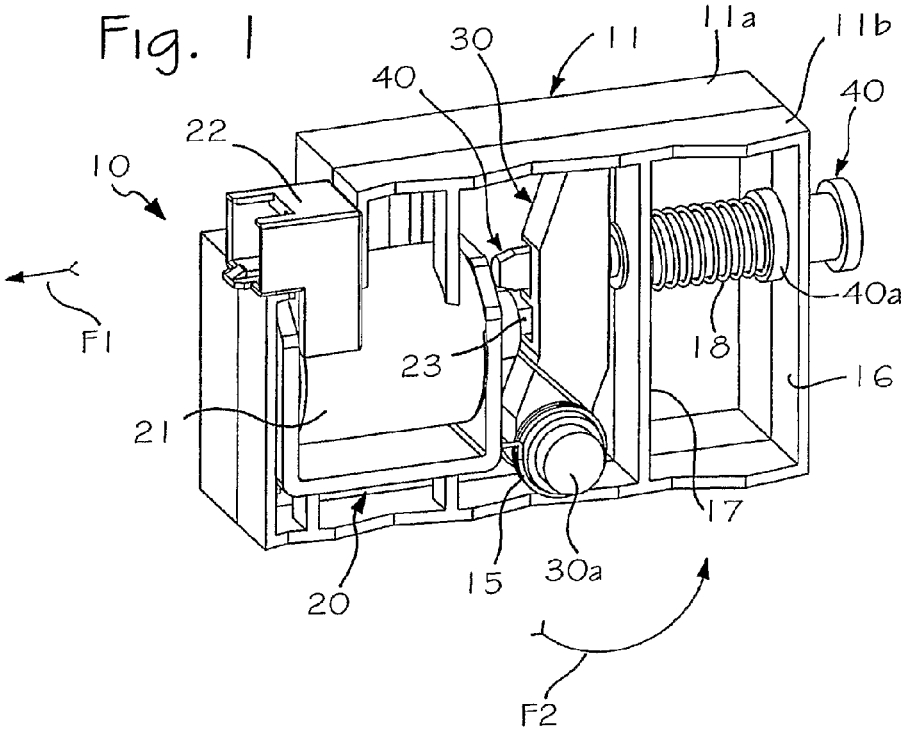
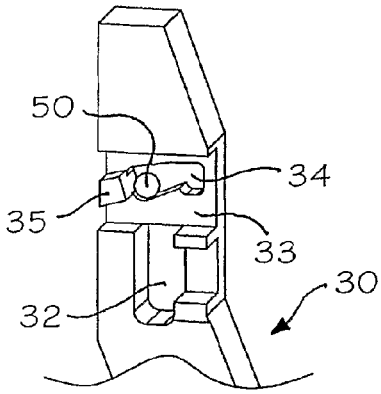
Fig. 2
Fig. 3
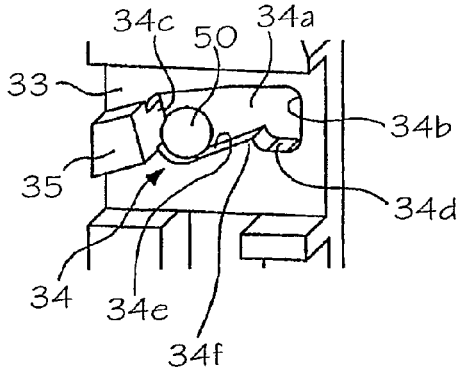

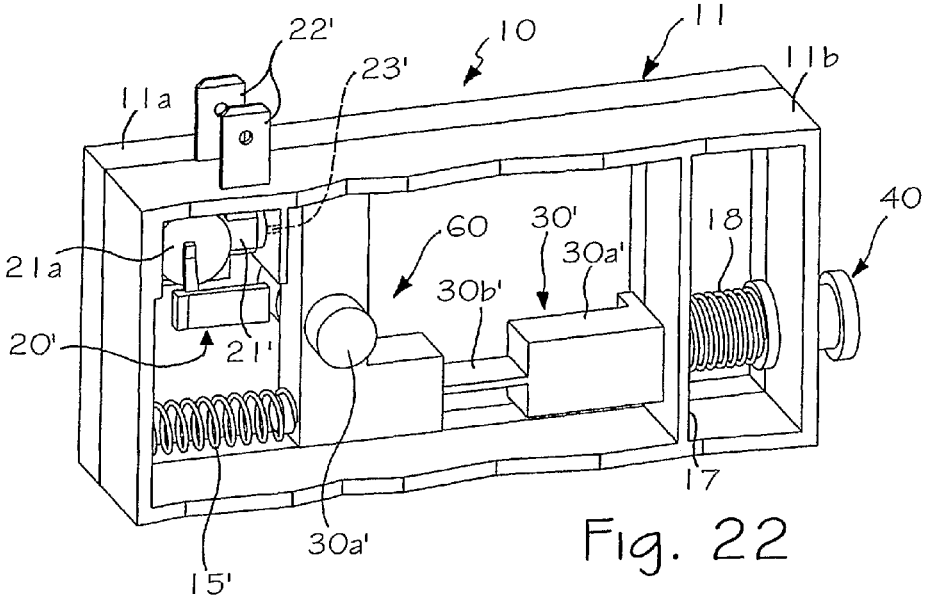
Fig. 22
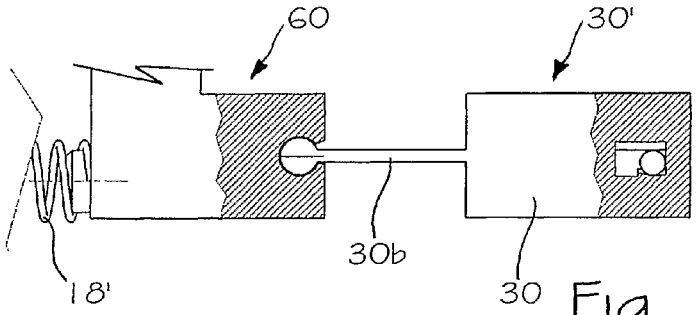
Fig. 23
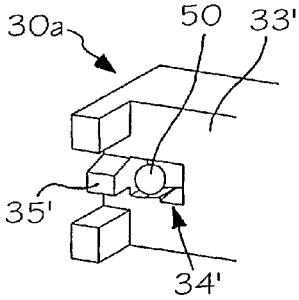
Fig. 24
Fig. 25
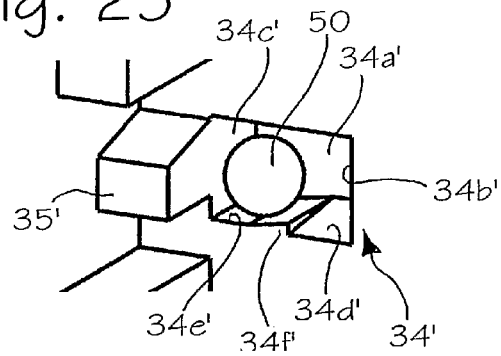

Fig. 26
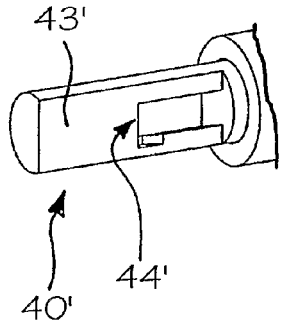
Fig. 27
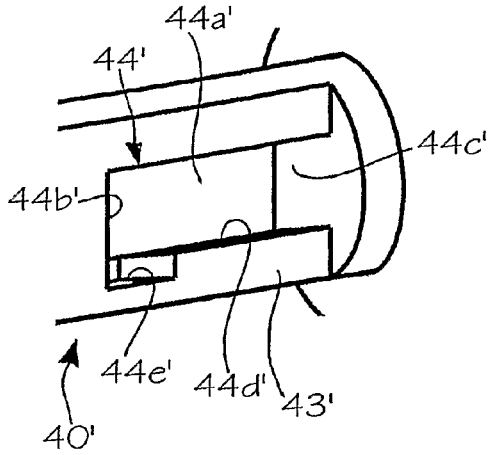
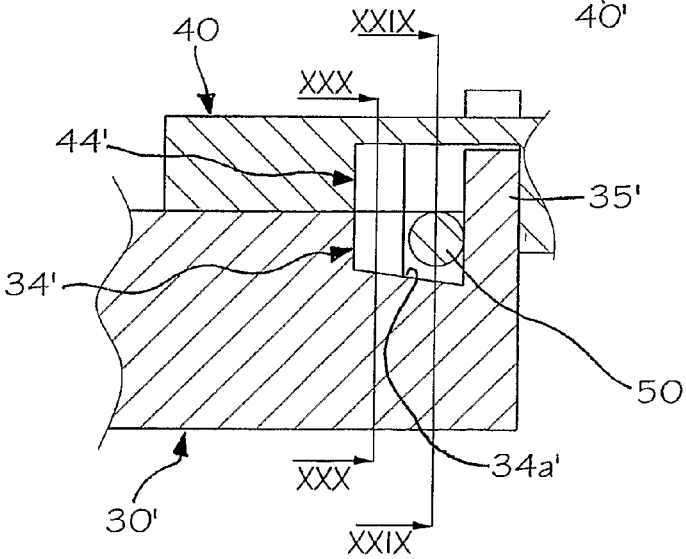
Fig. 28
Fig. 29
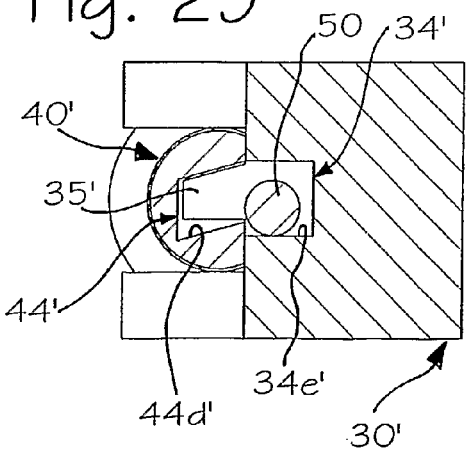
Fig. 30
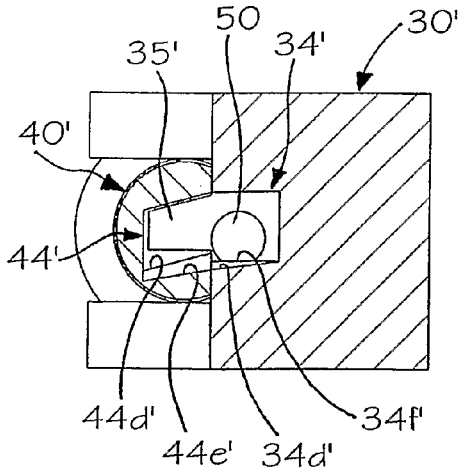

ACTUATION DEVICE AND METHOD

CROSS REFERENCE TO RELATED APPLICATIONS

This application is a national stage of PCT International Application No. PCT/IB2006/002202, filed on Aug. 3, 2006, and published in English on Feb. 15, 2007, as WO 2007/017749 A1, which claims priority from Italian patent application No. TO 2005A000555, filed on Aug. 5, 2005, the entire disclosures of which are incorporated herein by reference.

FIELD OF THE INVENTION

The present invention relates to actuation devices having a driving member, a driven member, and actuator means, which can be operated to produce a movement of the driving member; the invention has been developed with particular attention being paid to devices in which the predetermined movement of the driving member is adapted to cause, in a selective way, stokes of different lengths of the driven member.

STATE OF THE PRIOR ART

Actuation devices of the type referred to above are used in various fields, such as the field of electrical household appliances. For example, many washing machines are provided with a dispenser for washing agents, which comprises a container, usually configured as drawer, defining a plurality of compartments, provided for containing individual doses of one and the same washing agent, or else of different washing agents (for example, a detergent for carrying out a pre-washing step, a detergent for carrying out a washing step in the strict sense, a rinsing additive or rinse aid, a bleaching agent, etc.).

The dispenser is configured in such a way that a flow of water is directed, selectively and at appropriate times, to the various compartments of the container so as to remove from an individual compartment the respective dose of washing agent and to carry it into a tank of the machine in order to perform a particular step of the operating program; for this purpose the dispenser typically comprises a movable nozzle, which is displaced linearly or angularly for directing each time the flow of water into the compartment in question of the container, under the control of a programmer device, or timer, of the machine. The actuation systems designed to produce the movement of the nozzle are generally cumbersome and complicated from the mechanical standpoint in the case where they are provided with just one actuator means, or else costly if they use a plurality of distinct actuators (see, for example, FR-A-2,596,778 and the corresponding discussion of the prior art).

Also in the case of dishwashers there is a widespread use of dispenser devices designed for supplying detergent and additives at different pre-set times, under the control of the timer of the machine. Said dispensers generally comprise a body associated to the front-loading door of the machine, defined in which is a single-dose compartment provided with a lid that is made to open at the appropriate moment of the washing step. Moreover defined in the body is a tank for the liquid additive, associated to which are interception means for control of the corresponding delivery. Some of these dispensers have an actuation system comprising a single actuator, provided for operating in all the delivery cycles (see, for example, EP-A-0 602 572). Also the systems with just one actuator of a known type used on dishwashers are generally distinguished by rather complicated and cumbersome mechanisms, which comprise a plurality of components that are particularly subject to wear over time.

SUMMARY OF THE INVENTION

In the light of what has been said above, the purpose of the present invention is mainly to provide an actuation device of new conception, that is extremely simple from the constructional and functional standpoint and is provided with a mechanism for coupling between the driving member and the driven member that is very compact and not very subject to wear. The above and other purposes are achieved, according to the present invention, by an actuation device and method having the characteristics specified in the annexed claims, which form an integral part of the descriptive contents of the present patent application.

BRIEF DESCRIPTION OF THE DRAWINGS

Further purposes, characteristics and advantages of the present invention will emerge clearly from the ensuing detailed description and from the annexed plate of drawings, which is provided purely by way of explanatory and non-limiting example and in which:

FIG. 1 is a partially sectioned perspective view of an actuation device according to the present invention;

FIGS. 2 and 3 are a perspective view and a corresponding enlarged detail, respectively, of a driving member and a floating body forming part of the device of FIG. 1;

FIG. 22 is a partially sectioned perspective view of an actuation device according to the invention, in a second embodiment;

FIG. 23 is a schematic view in partial cross section of a system for articulation between two components of the device of FIG. 22;

FIGS. 24 and 25 are a perspective view and a corresponding enlarged detail, respectively, of a portion of a driving member and of a floating body forming part of the device of FIG. 22;

FIGS. 26 and 27 are a perspective view and a corresponding enlarged detail, respectively, of a driven member forming part of the actuation device of FIG. 22;

FIG. 28 is a schematic longitudinal section of a coupling zone between the members of FIGS. 24 and 26;

FIGS. 29 and 30 are two schematic cross sections, respectively according to the line XXIX-XXIX and the line XXX-XXX of FIG. 28;

DETAILED DESCRIPTION OF PREFERRED EMBODIMENTS OF THE INVENTION

Figure 4:
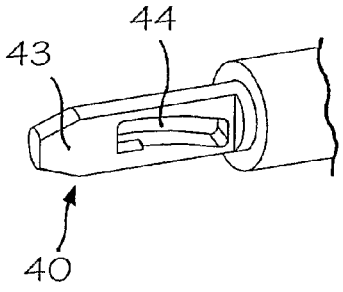
FIGS. 4 and 5 are a perspective view and a corresponding enlarged detail, respectively, of a driven member forming part of the device of FIG. 1.

In FIG. 1, the reference number 10 designates as a whole an actuation device built according to the invention having a casing 11, which, in the case exemplified, comprises a rear body portion 11*a* and a front body portion 11*b*, the latter being represented only partially. In the example of application proposed the casing 11 is adapted to assume an upright, or raised, position and a reclined, or lowered, position; for this purpose, as exemplified schematically in FIG. 6, conveniently associated to the casing 11 are means 13 for hinging to a generic fixed structure, designated by 14; in the sequel of the present description, it is assumed that the structure 14 forms part of a washing machine and that the casing 11 is articulated in relation to the position of a drawer forming part of a dispenser of washing agents, of the type indicated in the introductory part of the present description; the articulation and hinging system is such that, in the condition where the drawer is closed, the casing 11 is in its upright position (represented partially, for example, in FIGS. 8, 11, 14 and 17), whereas, with the drawer open, the casing 11 is in its reclined position (as may be seen in FIG. 6); it may be noted that, in this embodiment of the invention, both in the upright position and in the reclined position, the casing 11 remains in any case slightly inclined. Positioned in the casing 11 is an actuator, designated as a whole by 20; in the case exemplified, the actuator 20 is of the solenoid type, well known in the field and hence such as not to require any detailed description; here it is sufficient to point out that:

the actuator 20 comprises an induction winding or coil 21, associated to which is a connector 22 for electrical supply, and a movable core 23; and following upon supply of the coil 21, the core 23 is induced to move in the direction indicated by the arrow F1, countering the action of at least one elastic means.

The movable core 23 has a respective end that projects constantly from the coil 21 and is operatively constrained to a driving member; in the case exemplified, said member is constituted by an angularly movable lever, designated as a whole by 30; the lever 30 defines, in its bottom part, a pin-like portion 30*a*, used for hinging the lever itself to the casing 11. It may be noted that, according to a possible variant, instead of integrating a pin-like portion 30*a*, the lever 30 could be fitted to an angularly movable shaft.

The lever 30 is operatively constrained, in an intermediate area thereof, to a driven member; in the case exemplified, said member is constituted by a shaft or slider or rod 40, which is able to slide linearly in a direction parallel to the movable core 23, i.e., in the direction indicated by the arrow F1. As may be readily understood, the arrangement is such that, following upon supply of the coil 21, with the consequent recession of the movable core in the direction indicated by the arrow F1, the lever 30 is able to move angularly in the direction indicated by the arrow F2, countering the elastic reaction of a spring 15, in particular of the torsion type, interacting between the lever itself and the casing 11.

Figure 7:
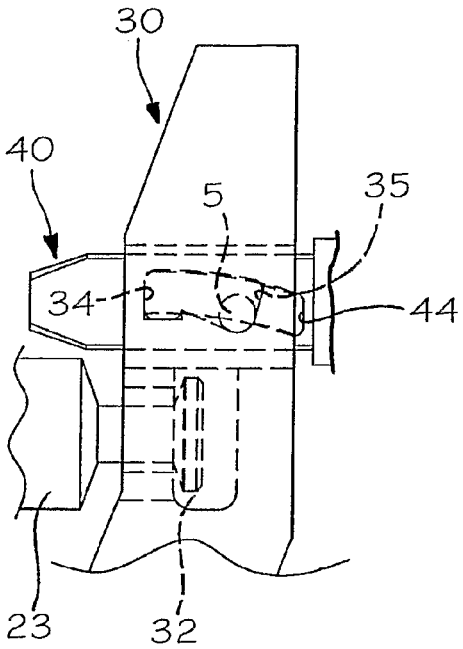
FIGS. 7-9 are, respectively, a side view, a cross-sectional view and a partially sectioned perspective view, these being schematic and partial views, of the actuation device according to the invention, in a first condition.

As may be seen in FIG. 2, made in an intermediate area of the lever 30 is an engagement slot or seat 32, designed to receive a shaped end of the movable core 23 (see, for example, FIG. 7). On top of the slot 32, the lever 30 then has a rectilinear region of reduced thickness, set transverse with respect to the axis of the lever 30, having a plane wall or surface 33; defined in said region is a shaped slot, which provides a seat designated as a whole by 34, open in a position corresponding to the aforesaid plane surface 33; moreover projecting from the plane surface 33 is an engagement part, here configured as appendage or relief 35. As may be seen in FIG. 3, the seat 34 has a bottom surface 34*a* and a peripheral profile in which there may be identified an upper surface (not indicated), two longitudinal end surfaces 34*b*, 34*c* and a lower surface, the latter being shaped so as to define a substantially plane portion, designated by 34*d*, and a portion shaped like an inclined plane, designated by 34*e*, a cusp 34*f* being formed between said portions. From FIG. 3 it may moreover be noted that, in the case exemplified, the relief 35 has a lateral surface substantially in common with the longitudinal end surface 34*c* of the seat 34.

To return to the example of FIG. 1, the end of the rod 40 opposite to the actuator 20 comes out of the casing 11, via a passage defined in a side wall 16 of the casing itself; said end of the rod 40 is designed to actuate or move a generic interlocked member or system (not represented in the figures), which here is assumed as being a transmission rod connected to a nozzle provided for directing selectively a flow of water towards the compartments of the aforesaid drawer of the dispenser for washing agents. The rod 40 passes also through a second opening, formed in an internal wall 17 of the casing 11. In an intermediate position thereof, the rod 40 has a flange-shaped contrast element 40*a*, in the area comprised between the walls 16 and 17, and mounted on the rod itself is a spiral spring 18, designed to be loaded in compression; one end of the spring 18 bears upon the wall 17, whilst the other end bears upon the contrast element 40*a* of the rod 40. The end of the rod 40 close to the actuator 20, represented in FIG. 4, has a region of reduced cross section, defined in which is a substantially plane surface 43; formed in said region is a shaped slot, which provides a seat designated as a whole by 44, open in a position corresponding to the aforesaid plane surface 43; the seat 44 has a slightly arched longitudinal development and dimensions such as to be able to receive, with possibility of movement, the projecting portion 35 of the lever 30, as will emerge hereinafter.

Figure 5:
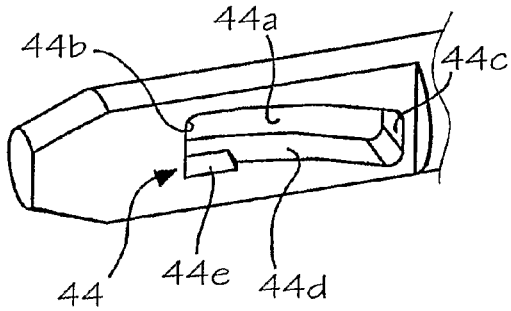

As may be seen in FIG. 5, the seat 44 has a bottom surface 44*a* and a peripheral profile in which it is possible to identify an upper surface (not indicated), two longitudinal end surfaces 44*b*, 44*c*, and a lower surface; the latter has a profile shaped so as to define a prevalent portion, designated by 44*d*, and a slide portion 44*e*, close to the longitudinal end surface 44*b*; as may be noted, the surface portion 44*e* is inclined in a direction transverse with respect to the development of the surface portion 44*d*, providing, that is, a sort of slide, which is lateral with respect to the latter. The seat 44, or at least said prevalent surface portion 44*d* is inclined with respect to the axis of the rod 40.

The lever 30 and the rod 40 can be conveniently made of thermoplastic material, via moulding operations.

Finally, in FIGS. 2 and 3, the reference number 50 designates a floating body, of dimensions such as to be containable both in the seat 34 and in the seat 44, with possibility of displacing selectively between the seats themselves, which are provided for the purpose, as will appear hereinafter; by the term "floating" is meant herein that the body 50 is preferably without constraints, or not joined to other parts, it remaining understood that said body 50, as has been said, is housed alternatively in the seats 34 and 44. In the embodiment exemplified, and at the moment deemed preferential, the aforesaid body is constituted by a ball, for example, a steel ball.

Figure 6:
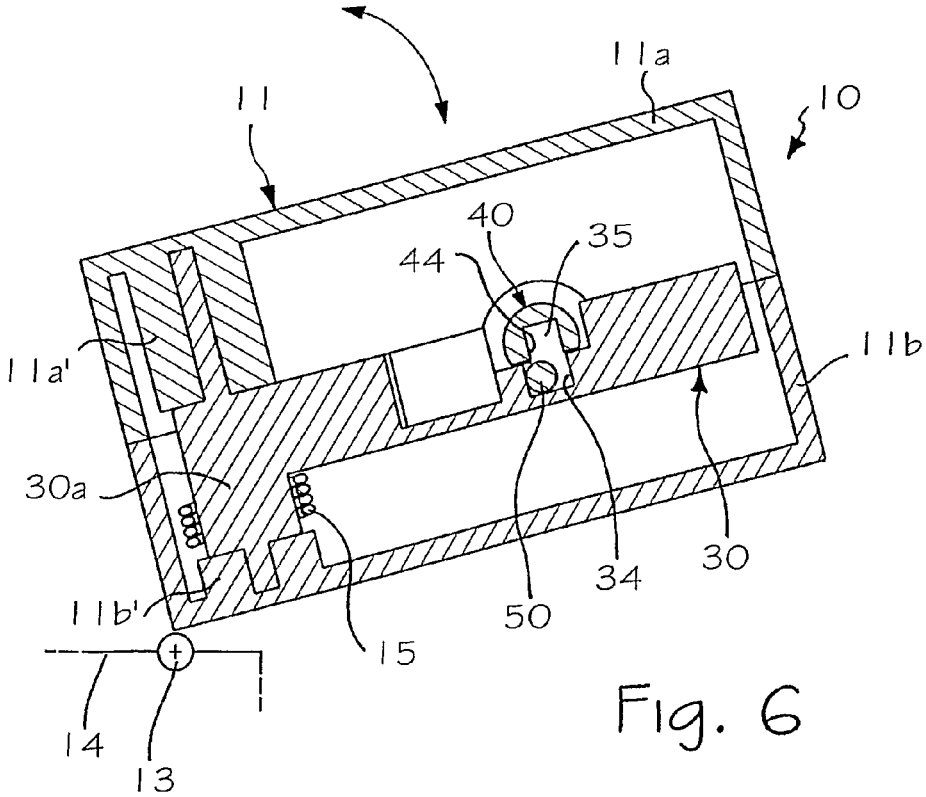
FIG. 6 is a schematic cross section of the device according to the invention, in a reclined condition.

Once the lever 30 and the rod 40 are assembled in the device 10, they are arranged in such a way that at least part of the respective plane surfaces 33 and 43, and hence at least part of the seats 34, 44, face one another, with the projecting portion 35 of the lever 30 inserted within the seat 44 of the rod 40, and with part of the rod 40 inserted in the region with reduced thickness of the lever 30 in which the surface 33 is formed. Said condition is visible in the schematic cross section of FIG. 6, represented in which are only the components of immediate interest for the purposes of an understanding of the invention (from FIG. 6 it may be noted how, in the example provided herein, the parts 11*a*, 11*b* of the casing will define respective seats 11*a*', 11*b*' for housing in a rotatable way the end of the pin-like portion 30*a* of the lever 30, on which the spring 15 is mounted). It should be noted that the surfaces 33 and 43 of the members 30 and 40 must not necessarily be plane, and could possibly be complementary to one another, and hence even of different shapes (for example, one surface with a convex profile which slides on a surface with a concave profile); in general terms, therefore, it is sufficient for the surfaces 33, 43 to be designed to co-operate with one another in sliding relationship.

To return to FIG. 6, the actuation device 10 is represented therein in an initial inoperative condition, with the casing 11 in its reclined position, which is obtained when the drawer for the washing agents is opened or pulled out of the respective seat. The same inoperative condition of the device 10, but with the casing 11 in the upright position (i.e., with said drawer closed), is represented limitedly to the parts of interest also in FIG. 7 and in the corresponding schematic cross section of FIG. 8, as well as in FIG. 9, where the lever 30 is partially sectioned in a position corresponding to the seat 34 (in practice, with a plane of partial cross section passing in the proximity of the bottom surface 34*a* of the seat 34). As may be appreciated, particularly from FIGS. 8 and 9, in the initial condition the seats 34 and 44 face one another and are set alongside one another, and the ball 50 is within the seat 34 of the lever 30, and in particular in the lowest stretch of the portion of lower surface 34*e*, in contact also with the longitudinal end surface 34*c*. Notwithstanding the inclination of the device 10, and hence of the members 30, 40, the ball 50 is prevented from moving into the seat 44 since, in the condition under examination, the portion of lower surface 44*d* of the seat 44 is found at a greater height than the portion of lower surface 34*e* of the seat 34; it should moreover be noted that, in this position, the bottom end of the slide portion 44*e* of the seat 44 is substantially at the same height as the portion of lower surface 34*d* of the seat 34.

Figure 8:
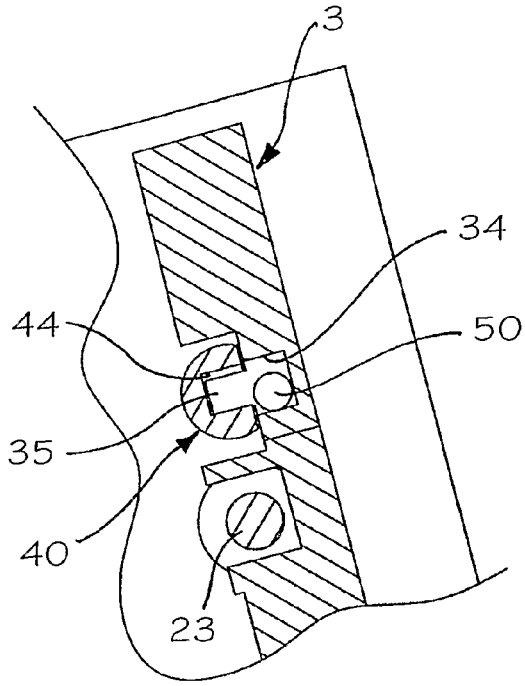
Figure 9:
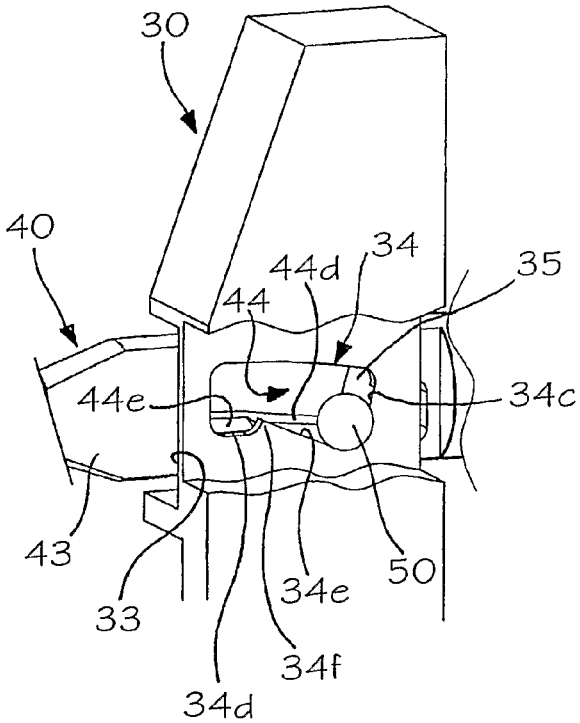
Figure 10:
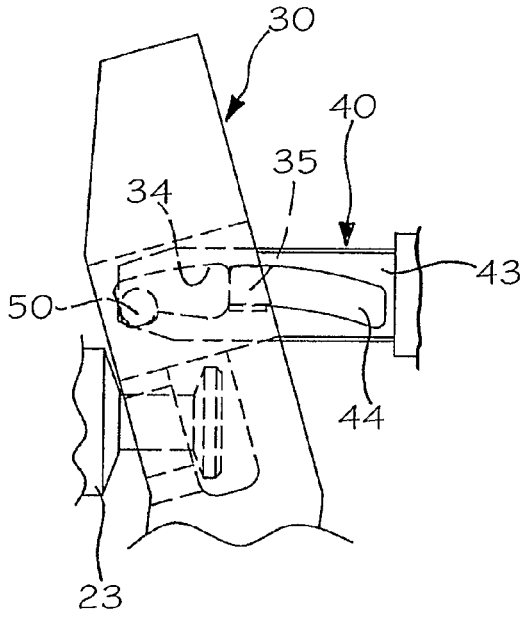
FIGS. 10-12 are views similar to the ones of FIGS. 7-9, but with the actuation device according to the invention in a second condition.
Figure 11:
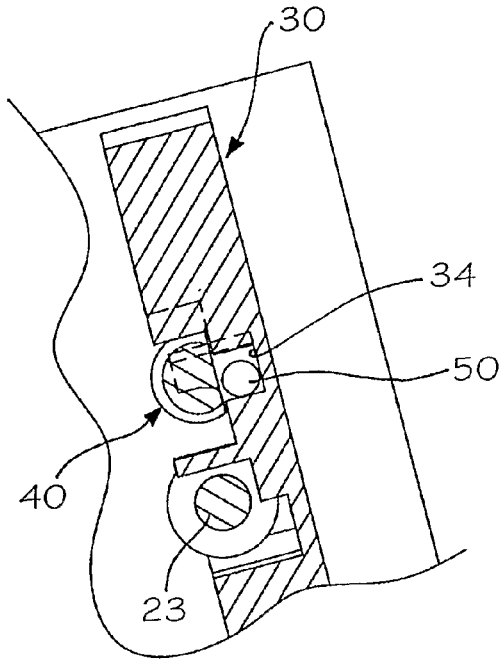

In the inoperative condition of FIGS. 7-9, the aforesaid nozzle of the dispenser for washing agents will be in a position such as to direct the corresponding flow of water towards a first compartment of the detergent drawer. When the nozzle is to be directed towards a second compartment of the detergent drawer, a control system (not represented) controls supply of the coil 21, thus determining recession of the core 23; it should be noted that the supply of the coil determines a fast and sudden movement of the core 23, with a consequent sharp angular movement of the lever 30 as far as the position visible in FIGS. 10-11. Part of the movement of the lever 30 is transmitted to the rod 40 thanks to the presence of the relief 35; in particular, in a first stretch of the angular movement of the lever 30, the relief 35 is free to slide within the seat 44, performing a maximum stroke therein, until it comes into contact with the end surface 44*b* shown in FIG. 5; after said contact, the remaining part of the angular movement of the lever 30 is transmitted to the rod 40 so as to produce displacement of the aforesaid nozzle in order to direct the water to the second compartment of the detergent drawer.

Figure 12:
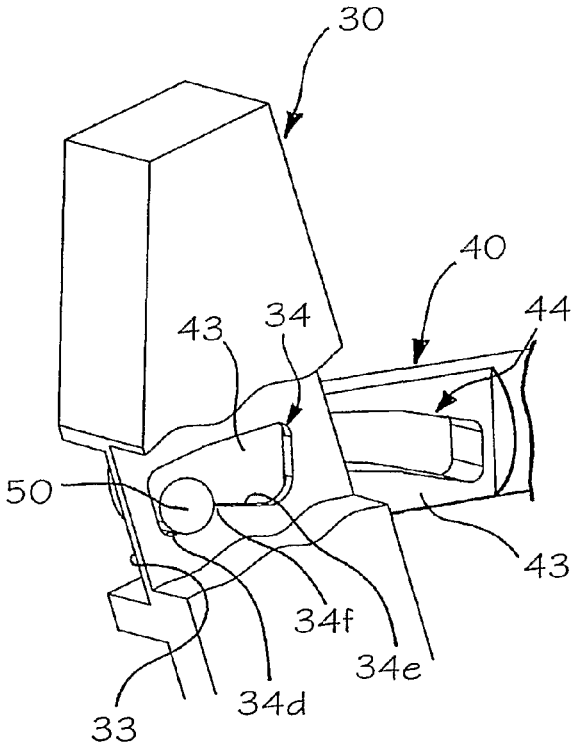
Figure 13:
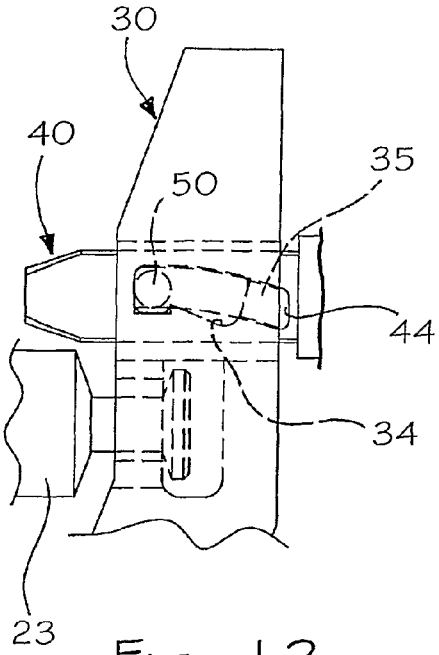
FIGS. 13-15 are views similar to the ones of FIGS. 7-9, but with the actuation device according to the invention in a third condition.
Figure 14:
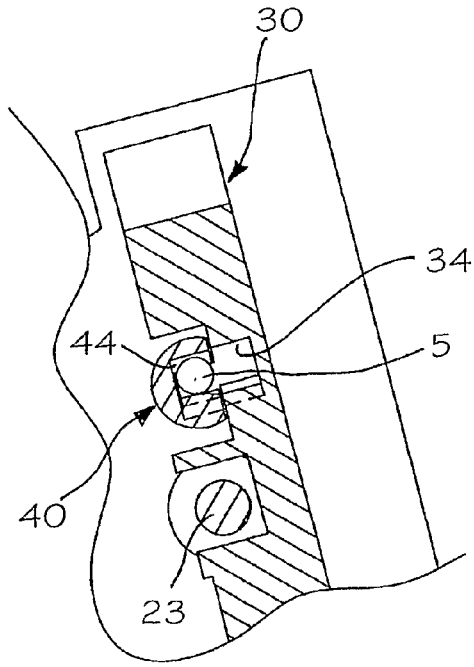
Figure 15:
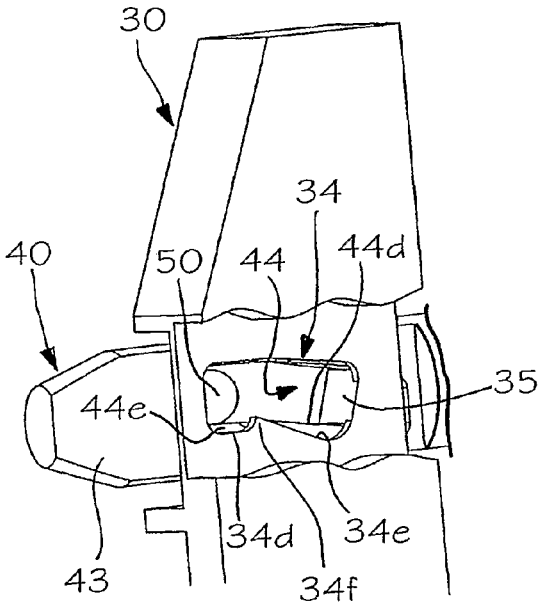

The sharp movement of the lever 30 is such that the ball 50 is induced to climb up the inclined plane defined by the portion of lower surface 34*e* of the seat 34, until it passes beyond the cusp 34*f* and then passes to the portion of lower surface 34*d*, as is clearly visible in FIG. 12; given the inclination of the device 10, the ball 50 rests laterally with respect to the surface 43 of the rod 40 and is maintained in the position that it has reached thanks to the presence of the cusp 34*f*. After the necessary flow of water has been directed to the second compartment of the detergent drawer, the electrical supply to the coil 21 is interrupted, with the core 23 and the lever 30 that return to their respective initial positions, thanks to the action of the springs 15 and 18, as represented in FIGS. 13-15. In this way, the surface 33 of the lever 30 slides with respect to the surface 43 of the rod 40, which is motionless, until the seats 34 and 44 once again face one another, as may be seen, for example, in FIG. 15, with the portion of lower surface 34*d* of the seat 34 that is once again in a position corresponding to the slide portion 44*e* of the lower surface of the seat 44; as has been said, in this position the bottom end of the slide portion 44*e* is substantially at the same height as the portion of lower surface 34*d*. In this way, given the inclined arrangement of the device 10, the ball 50 is free to roll from the portion 34*d* of the seat 34 onto the slide portion 44*e* of the seat 44, as may be seen in FIG. 15, and then roll on the portion of lower surface 44*d* (see FIG. 5) of the seat 44, until it reaches a position in which it rests against the lateral surface of the relief 35, inserted in said seat. In effect, then, the ball 50 passes from the seat 34 to the seat 44; the ball remains in said position thanks to the inclination of the device 10 and to the slightly arched shape of the seat 44.

Figure 16:
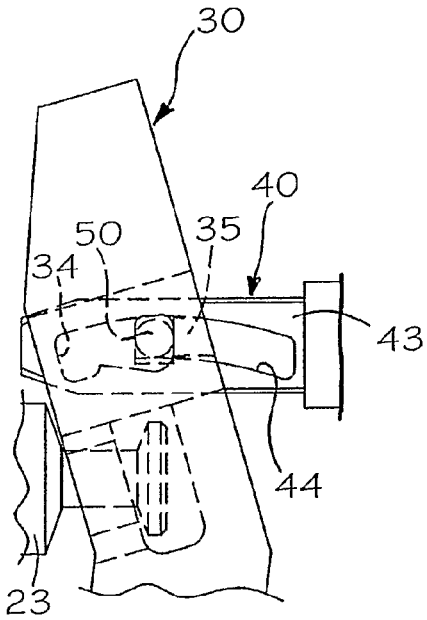
FIGS. 16-18 are views similar to the ones of FIGS. 7-9, but with the actuation device according to the invention in a fourth condition.
Figure 17:
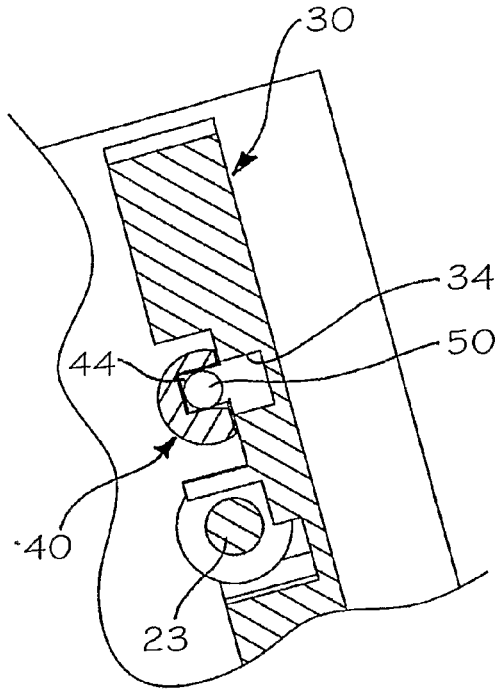
Figure 18:
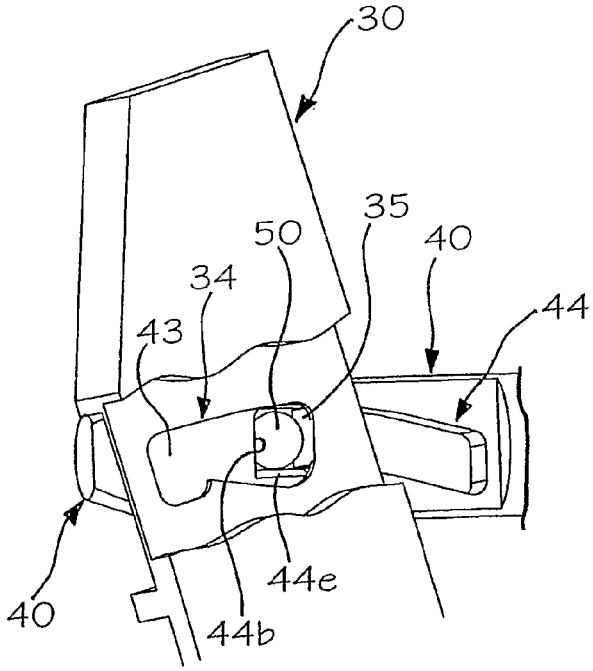

At a subsequent moment, when it becomes necessary to produce a greater stroke of the rod 40 in order to be able to direct the aforesaid nozzle towards a third compartment of the detergent drawer, the control system brings about a new supply of the coil 21, thus bringing about a new recession of the core 23 and hence a new angular movement of the lever 30, as may be seen in FIGS. 16-18. In the course of the movement of the lever 30, the respective relief 35 is free to slide within the seat 44 of the rod 40; however, unlike what occurs in the course of the first actuation (FIGS. 10-12), in this condition the ball 50 is housed within the seat 44, thus reducing the stroke allowed for the relief 35 within the seat 44. In the course of its stroke, the relief 35 will displace the ball 50 along the seat 44; at a certain point, as illustrated in FIG. 18, the ball 50 will then come to rest, on one side, against the end surface 44*b* of the seat 44, and, on the opposite side, a thrust will be exerted on said ball 50 by the relief 35 of the moving lever 30. It is evident how, unlike the previous actuation, a greater part of the angular movement of the lever 30 will in this case be transferred to the rod 40, with a consequent linear translation of the latter. As may be readily understood, the amount of said translation is a function of the overall dimensions of the ball 50. The movement thus obtained of the rod 40 determines the desired actuation. Also in this case, after the necessary flow of water has been directed to the third compartment in question of the detergent drawer, the electrical supply to the coil 21 is interrupted. When supply of the coil 21 ceases, the core 23, the lever 30 and the rod 40 will return to their respective resting positions by virtue of the action of the springs 15 and 18, as may be seen, for example, in FIG. 15; it should be noted that, in actual fact, as compared to FIG. 15, the ball 50 will roll once again along the seat 44, until it comes to rest against the relief 35.

Of course, should operation of the device 10 need to produce one or more further movements of extensive stroke of the rod 40, the coil 21 will once again be supplied, thus producing an operation of the actuation device 10 that is similar to what has been described with reference to FIGS. 16-18.

Restoring or resetting the initial condition of FIGS. 7-9 is obtained by bringing the device 10 into its reclined position, as is, for example, visible in FIG. 6, opening the drawer of the washing agents. As may be readily understood from said FIG. 6, when the device 10 is turned over, the seats will come to assume a position where they are set on top of one another, in particular with the seat 44 of the rod 40 above the seat 34 of the lever 30, and with the ball 50 that may thus freely pass or fall by gravity from the first seat to the second seat. Next, the device 10 will be brought back again into the upright position (see, for example, FIGS. 8, 11, 14, 17) by closing the detergent drawer. In the course of said angular movement of the device 10, the ball 50 will be prevented from passing into the seat 44 since, as has been said, in the inoperative condition of the actuation device, the portion of lower surface 44*d* (see FIG. 9) of the seat 44 is found at a greater height than the portion of lower surface 34*e* of the seat 34.

Figure 19:
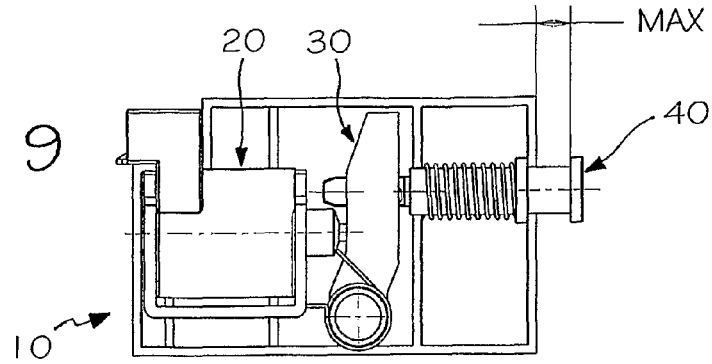
FIGS. 19, 20 and 21 are partial and schematic front views of the device according to the invention in the aforesaid first, second and fourth conditions, respectively.
Figure 20:
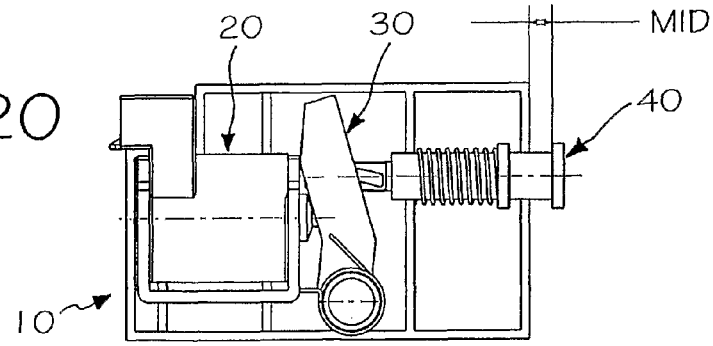
Figure 21:
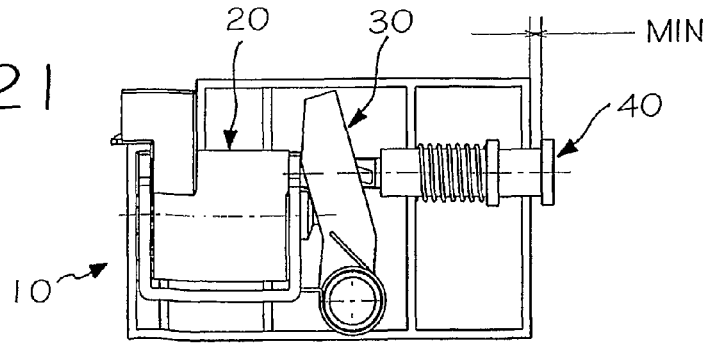

In FIGS. 19, 20 and 21 the actuation device 10 is represented schematically in the three conditions illustrated in FIGS. 7-9 (or else 13-15), 10-12 and 16-18. As may be readily noted, the end of the driven member 40 has, in FIGS. 19-21, three different positions; namely:

in FIG. 19 the device 10 is in an inoperative condition, with the member 40 that projects by a maximum amount MAX from the casing 11; as has been explained, in said condition the nozzle connected to the member 40 will be in a first position, designed to direct a flow of water into a first compartment of the detergent drawer, such as for example the compartment that contains a detergent necessary for performing a pre-washing step;

in FIG. 20 the device 10 is in a first operative condition, determined by the first actuation, with the member 40 that projects by an intermediate amount MID from the casing 11, having performed a stroke of a reduced amount; in said condition, the nozzle connected to the member 40 will be in a second position, designed to direct a flow of water into a second compartment of the detergent drawer, such as, for example, the compartment that contains a detergent necessary for performing the washing step in a strict sense; and in FIG. 21 the device 10 is in a second operative condition, determined by the second actuation, with the member 40 that projects by a minimum amount MIN from the casing 11, having performed a stroke of a larger amount as compared to the case of FIG. 20; in said condition, the nozzle connected to the member 40 will be in a third position, designed to direct a flow of water into a third compartment of the detergent drawer, such as, for example, the compartment that contains a softening agent.

As has been said, the conditions represented in FIGS. 19-21 arise in the course of a washing cycle, with the device 10 in the respective upright position (FIG. 8 or FIGS. 14, 11 and 17); in order to perform a subsequent cycle, the user of the washing machine will have to open the detergent drawer so as to introduce the necessary washing agents, and in this way the device 10 will be brought automatically into the reclined position of FIG. 6; the subsequent closing of the drawer, after introduction of the various washing agents, will bring back the device 10 into the upright position, ready for a new washing cycle.

The embodiment of the invention exemplified previously presupposes, for its operation, a certain degree of inclination of the device 10. It is, however, clear that the device 10 as a whole and/or the members 30, 40 and/or the seats 34, 44 could be configured for enabling the device 10 to operate according to other possible planes of lie, and particularly a plane of lie in which the reclined position of the device is substantially horizontal and the upright position of the device is substantially vertical. The simplest way, for example, is that of forming or mounting the actuation device 10 and/or the members 30 and 40 with respect to the casing 11 with a slightly inclined configuration, in the direction desired for producing the effects described above. Another possible embodiment is, instead, exemplified in FIGS. 22-38, in which the same numbers as the ones used in the previous figures are partly re-used.

The device 10 illustrated in FIG. 22 is provided with an actuator 20' of a type different from that of the previous embodiment, in particular an electro-thermal actuator, or thermo-actuator, well known in the field. Said actuator 20' comprises a container body 21' defining a chamber in which a thermally expandable material (such as a wax or a liquid) is present and partially inserted in which is a respective plunger shaft or piston, designated by 23'. The actuator 20' then comprises an electrical heater 21*a*, for example a positive-temperature-coefficient resistor or PTC, and electrical-supply terminals 22'. In operation, the heater 21*a* is supplied via the terminals 22', so as to produce an increase in temperature of the body 21'; in this way, the material contained in the body 21', by being heated, increases in volume and thus pushes the piston 23' outwards; next, when interruption of the electrical supply ceases, the body 21' and the material contained therein cool down progressively, with a consequent reduction in volume of the material itself, and the piston 23' returns towards the inside of the body 21', also under the action of at least one of the elastic elements of the system. It should be noted that the actuator 20' could possibly be provided with a respective casing, in which the body 21', the heater 21*a* and at least part of the terminals 22' will be housed; in a casing of this sort also an actuation shaft, linearly displaceable via the piston 23', would be at least partly inserted.

In the embodiment illustrated in FIG. 22, the piston 23' of the actuator 20' is designed to produce the angular movement of a lever 60 hinged via a pin 30*a'*; in the example, the lever 60 is as a whole L-shaped, with a first end portion, upon which the actuator 20' is designed to exert a pushing action, and a second end portion, articulated to which is a driving member, designated by 30', the functions of which, as regards the modalities of interaction with a respective driven member, are similar to the ones of the member 30 of the first embodiment. Operatively set between the lever 60 and the main body 11 of the device 10 is an elastic element, such as a spiral spring designated by 15'. It should be noted that the lever 60 and the driving member 30' could possibly be made of a single piece, for example, of moulded thermoplastic material, in such a way that the driving member 30' will comprise or will integrate also the lever 60.

The member 30' has a main body portion, designated by 30*a*, departing from which is a connection portion 30*b*, of a reduced cross section. The connection portion 30*b* is articulated, with a certain possibility of relative movement, to an end region of the lever 60; a possible system of articulation between the lever 60 and the member 30' is illustrated schematically in FIG. 23. In the case referred to above of a driving member 30' that comprises or integrates the lever 60, the connection portion 30*b* is preferably articulated in a flexible or elastic way, in particular by virtue of the characteristics proper to the aforesaid thermoplastic material. The aforesaid main body portion 30*a* is, instead, operatively coupled or constrained to a driven member, which, as in the previous embodiment, is constituted by a rod, shaft or slider, designated by 40'.

The arrangement of the parts is such that, following upon supply of the thermo-actuator 20', the shaft 23' exerts a thrust on the top area of the lever 60, with the latter that moves angularly in a clockwise direction (as viewed in FIG. 22—see also FIG. 40), countering the elastic reaction of the spring 18, causing a pulling action on the driving member 30' and a variation of its overall slope with respect to the normal horizontal position.

As may be seen in FIG. 24, the portion 30*a* of the member 30' has a plane face or surface 33', in a position corresponding to which a shaped slot is defined, which provides an as a whole rectilinear seat, designated by 34', open in a position corresponding to the aforesaid plane surface 33'; from the surface 33' there moreover projects an engagement part, also in this case configured as appendage or relief 35'. The seat 34' and the relief 35' basically have the same functions as the seat 34 and relief 35 of the first embodiment. As may be seen in FIG. 25, also the seat 34' has a bottom surface 34*a'*, an upper surface, not indicated, two longitudinal end surfaces 34*b'*, 34*c'* and a lower surface; as may be seen also in FIGS. 29 and 30, the lower surface of the seat 34' is shaped so as to define:

a portion 34*d'* inclined transversely downwards or forwards, starting from the bottom surface 34*a'* of the seat 34' as far as the face 33' (the portion 34*d'* could possibly be inclined towards the bottom surface 34*a'*);

a substantially plane portion, designated by 34*e'*; and an inclined wall defining a cusp 34*f'*, formed between the portions 34*d'* and 34*e'*.

In this embodiment, moreover, the seat 34' has a depth that increases starting from the end surface 34*b'* as far as the end surface 34*c'*; in other words, and as is clearly visible in FIG. 28, the bottom surface 34*a'* of the seat 34 is as a whole inclined.

The rod 40' is partially visible in FIG. 26, which also in this example comprises an end region, which has a substantially plane surface 43' and formed in which is a shaped slot, which provides a seat 44', which is open in a position corresponding to the aforesaid plane surface 43' and basically has the same functions as the seat 44 of the first embodiment; the seat 44' has a rectilinear longitudinal development and dimensions such as to be able to receive, with possibility of movement, the projecting portion 35' of the member 30', as is clearly visible in FIGS. 29 and 30.

As may be seen in FIG. 27, the seat 44' has a bottom surface 44*a'*, an upper surface, not indicated, two longitudinal end surfaces 44*b'*, 44*c'* and a lower surface. From FIGS. 29 and 30 it may be noted how the upper surface and the lower surface of the seat 44' are as a whole inclined in a direction transverse with respect to the development of the seat itself; the lower surface is shaped so as to define a prevalent portion 44*d'* and a portion 44*e'* defined hereinafter as "slide portion", at a slightly lower level with respect to the portion 44*d'* (from the comparison between FIGS. 29 and 30 it may be noted how the surface portion 44*e'* and the prevalent portion 44*d'* have very similar slopes, but lie on different planes).

Also in the embodiment in question a floating element 50 of a spheroidal shape is provided.

In the case of the variant in question, it is envisaged for the device 10 to be able to assume a reclined position that is substantially horizontal and an upright position that is substantially vertical.

Figure 31:
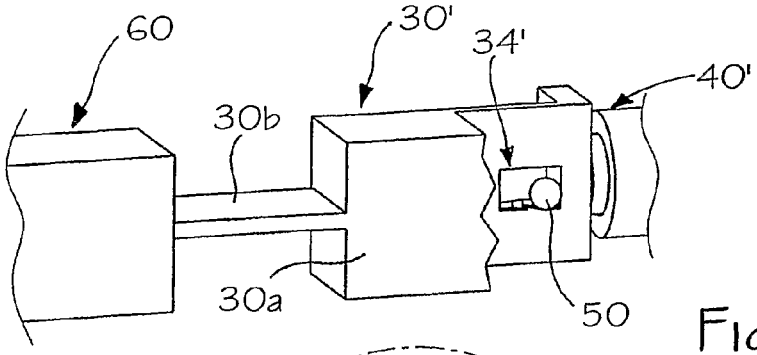
FIGS. 31 and 32 are a partially sectioned perspective view and a corresponding enlarged detail, respectively, of a part of the actuation device of FIG. 22, in a first condition.
Figure 32:
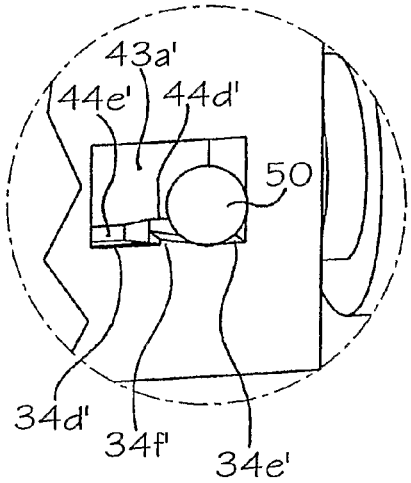

Visible in FIGS. 31 and 32 is its initial inoperative condition, which precedes a first actuation of the device 10, in which the ball 50 is located within the seat 34 of the lever 30, and in particular in the portion of lower surface 34*e'*. As may be appreciated also from FIG. 29, the ball 50 is prevented from displacing within the seat 44' since, in the condition in question, the portion of lower surface 44*d'* of the seat 44' is at a greater height than the portion of lower surface 34*e'* of the seat 34'; from FIG. 30 it may instead be noted how, in this position, the bottom end of the slide portion 44*e'* of the seat 44' is substantially at the same height as the portion of lower surface 34*d'* of the seat 34.

Figure 33:
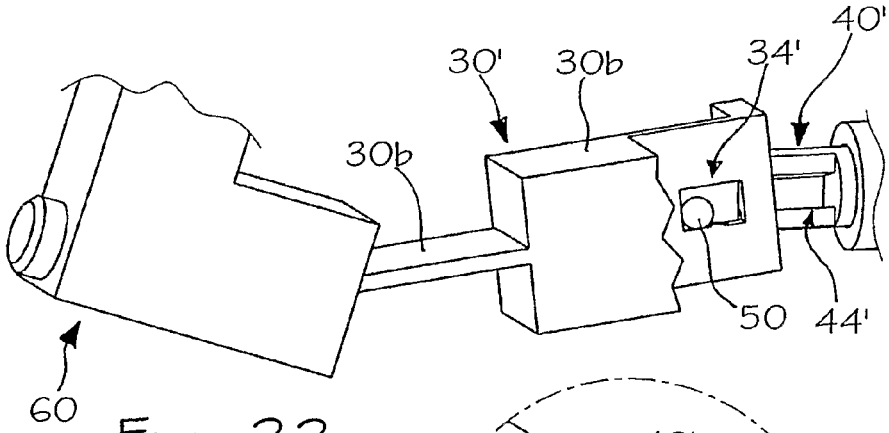
FIGS. 33 and 34 are, respectively, a view and a detail similar to those of FIGS. 31 and 32, with the actuation device in a second condition.
Figure 34:
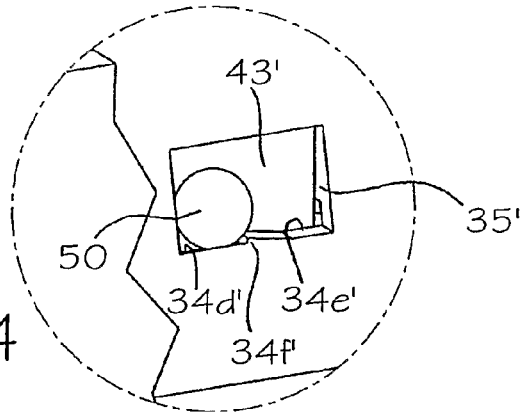

When the first actuation is to be produced, with a limited stroke of the rod 40', the control system of the device 10 controls supply of the actuator 20' of FIG. 22, thus determining advance of the piston 23' (see also FIG. 40), which in turn causes angular movement of the lever 60 as far as the position visible in FIG. 33. It should be noted that, on account of the characteristics proper to thermo-actuators, the movement of the piston 23' is relatively slow, unlike the sharp movement of the core 23 proper to a solenoid actuator. The movement of the lever 60 occurs about the pin 30*a'*; thanks to the articulated coupling existing between the lever 60 and the member 30' (see FIG. 23), the movement of the lever 60 causes both a pulling action on the member 30' and a certain angular movement thereof; the variation of the overall slope of the member 30' is such that the ball 50 will be able to pass beyond the cusp 34*f'* of the seat 34' and set itself in the portion of lower surface 34*d'*, as may be seen in FIG. 34. Also in this case, a part of the pulling action exerted on the member 30' is transferred to the rod 40'; for said purpose, the relief 35' is first free to slide within the seat 44', until it reaches a position where it bears upon the end surface 44*b'* of the seat 44' (see FIG. 27); from this point on, the further movement of the member 30' is transmitted to the rod 40'. At the end of the movement, the seat 34' also in this case faces a full region of the surface 43' of the rod 40' (see FIG. 34).

It should be noted that, during the first—relatively slow—cycle of actuation of the actuator 20', the ball 50 could reach a position corresponding to the slide portion 44*e'* even before it has passed beyond the cusp 34*f*, with the apparent risk that the ball itself may pass, already in this step, onto the slide portion 44*e'*; in actual fact, however, in the course of the movement, the member 30' is inclined, dropping slightly with respect to the member 40' and thus determining a step between the two seats 34', 44' that is in itself sufficient to prevent the aforesaid risk. In any case the surface portion 34*d*' of the seat 34' could be inclined towards the bottom surface 34*a*', as mentioned previously, should it be deemed necessary to eliminate also the aforesaid apparent risk.

Figure 35:
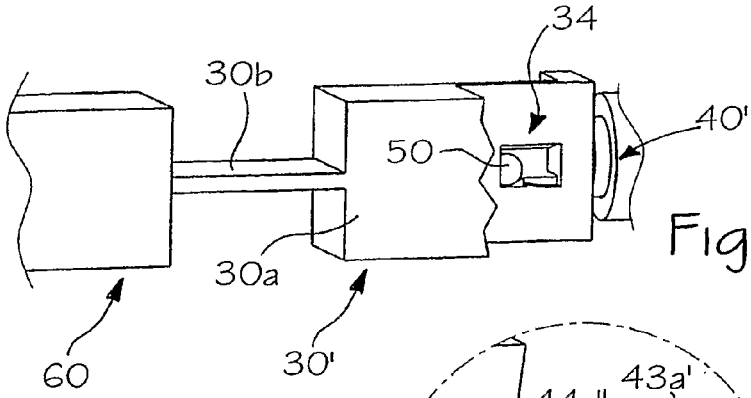
FIGS. 35 and 36 are, respectively, a view and a detail similar to those of FIGS. 31 and 32, with the actuation device in a third condition.
Figure 36:
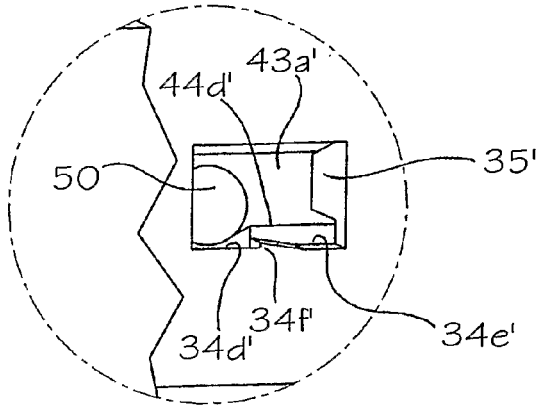

After interruption of the supply to the actuator 20', the shaft 23', the lever 60 and the member 30' return into their respective initial positions, as represented in FIGS. 35 and 36. In a way similar to the case of the first embodiment, the surface 33' of the member 30' slides with respect to the surface 43' of the rod 40', until the seats 34' and 44' again face one another. In this position (see also FIG. 30 for reference) the bottom end of the slide portion 44*e*' is substantially at the same height as the top of the portion of lower surface 34*d*'. In this way, given the inclined arrangement of the portion of lower surface 34*d*', the ball 50 is free to roll on the slide portion 44*e*' of the seat 44, which is inclined in the same direction, until it comes into contact with the bottom surface 44*a*'. The ball 50 passes then from the seat 34' to the seat 44', remaining in the latter seat thanks to the inclination of the lower surface 44*d*'-44*e*' of the seat 44; it should be noted that, in effect, the ball 50 remains within the slide portion 44*e*', given that the latter extends at a height lower with respect to the portion of lower surface 44*d*' of the seat 44.

Figure 37:
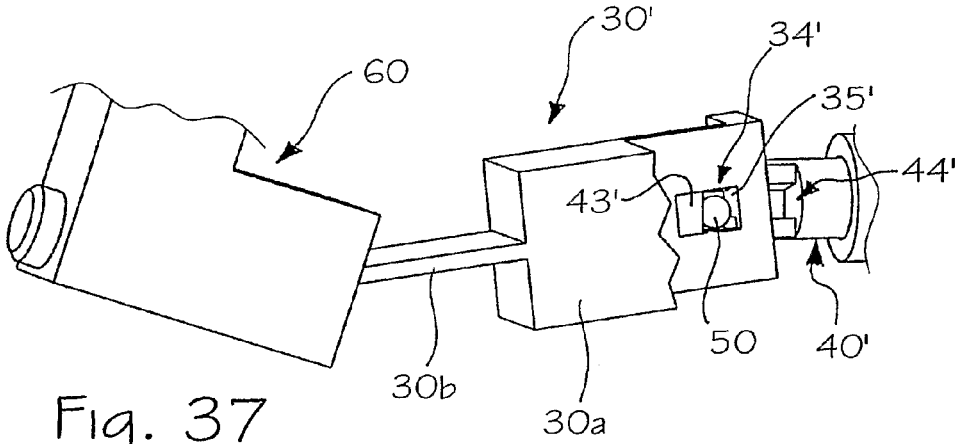
FIGS. 37 and 38 are, respectively, a view and a detail similar to those of FIGS. 31 and 32, with the actuation device in a fourth condition.
Figure 38:
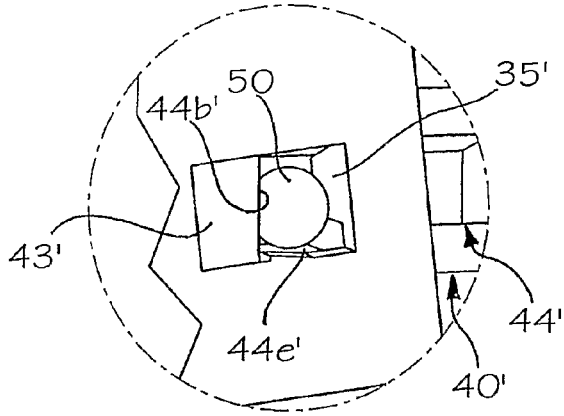

When, subsequently, actuation with a greater stroke of the rod 40' becomes necessary, the control system of the device 10 brings about a new supply of the actuator 20', thus causing a new angular movement of the lever 60 and hence a new action of pulling/inclination of the member 30', as may be seen in FIGS. 37 and 38. During sliding of the member 30', the respective relief 35' can slide within the seat 44' of the rod 40', in which the ball 50 is now housed. As for the first embodiment, the stroke allowed for the relief 35' within the seat 44' is thus reduced so that, at a certain point—as illustrated in FIG. 38—the ball 50 will be set between the end surface 44*b*' of the seat 44' and the relief 35' of the moving member 30'. Part of the movement of the member 30' is then transferred to the rod 40', with the consequent linear translation of the latter, of a greater amount as compared to the first actuation. After interruption of the supply to the actuator 20', the piston 23', the lever 60, the member 30' and the rod 40' will return to the position of FIGS. 35 and 36.

It should be noted that, also in the case of repeated cycles of actuation of the member 30' and hence of the rod 40', the ball 50 remains normally set in a position corresponding to the slide portion 44*e*', consequently not being subjected to any significant displacements within the seat 44'.

Also in this embodiment, resetting of the actuation system to the initial condition of FIGS. 31 and 32 is obtained by bringing first the device 10 into a reclined or substantially horizontal position. When the device 10 has been turned over, the seat 44' of the rod 40' comes to occupy a position above the seat 34' of the member 30', with the ball 50 that can thus freely pass from the first seat to the second seat. In this case, given the inclined arrangement of the end wall 34*a*' of the seat 34' (see FIG. 28), the ball 50 is induced to roll until it comes into contact with the end surface 34*c*'. During subsequent raising of the device 10 towards the respective upright position, the ball 50 will remain in the position reached, i.e., within the portion of lower surface 34*e*' (see, for example, FIG. 25), without being able to pass into the seat 44' (as has been said—see once again FIG. 29—the portion of lower surface 44*d*' of the seat 44' is at a greater height than the surface portion 34*e*' of the seat 34).

Figure 39:
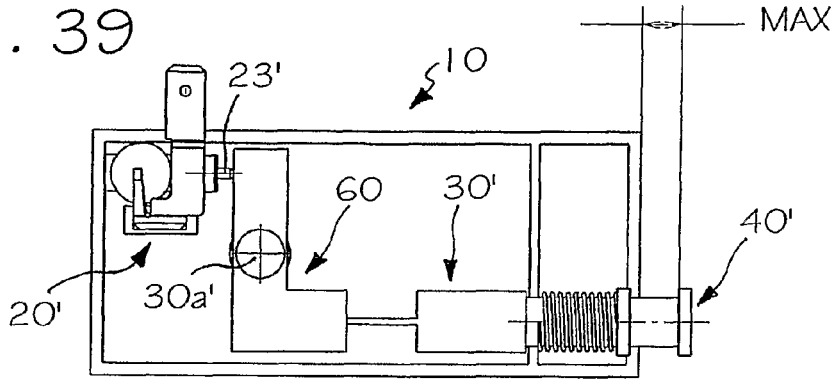
FIGS. 39, 40 and 41 are partial and schematic front views of the actuation device of FIG. 22 in the aforesaid first, second and fourth conditions, respectively.
Figure 40:
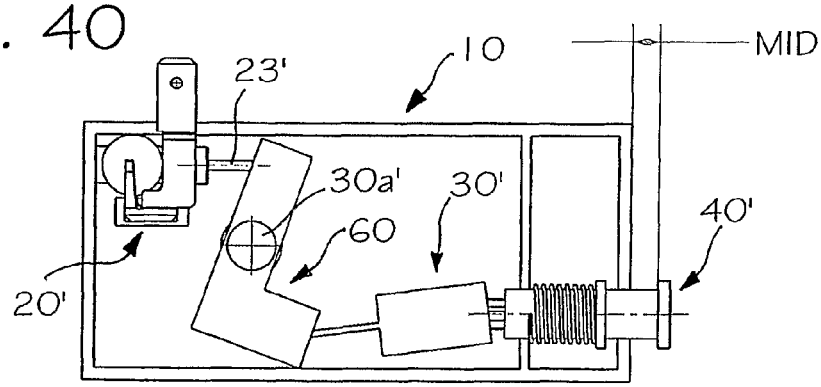
Figure 41:
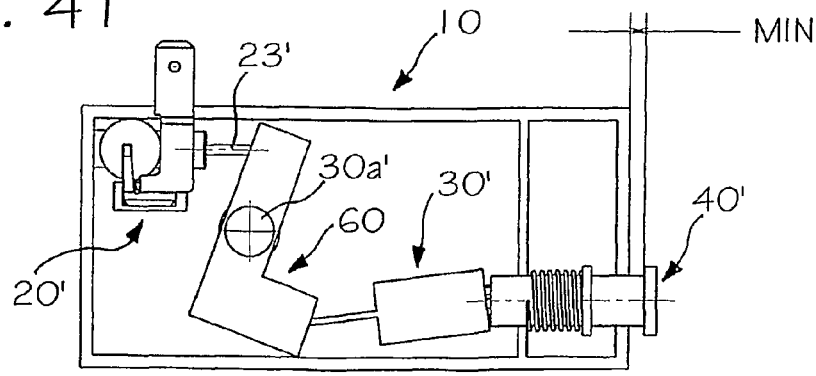

In FIGS. 39, 40 and 41 the actuation device 10 of the second embodiment of the invention is illustrated schematically in the three conditions represented in FIGS. 31-32 (or else 35-36), 33-34 and 37-38. Also in this case, it may be readily noted how the end of the driven member 40' will present, in FIGS. 39-41, the three different positions MAX, MID and MIN, as described previously also for the first embodiment, in relation to FIGS. 19-21. Also the conditions illustrated in FIGS. 39-41 arise in the course of a washing cycle, with the device 10 in the respective upright position; resetting of the system comes about before starting a new washing cycle on the washing machine, via opening and re-closing of the detergent drawer.

Figure 42:
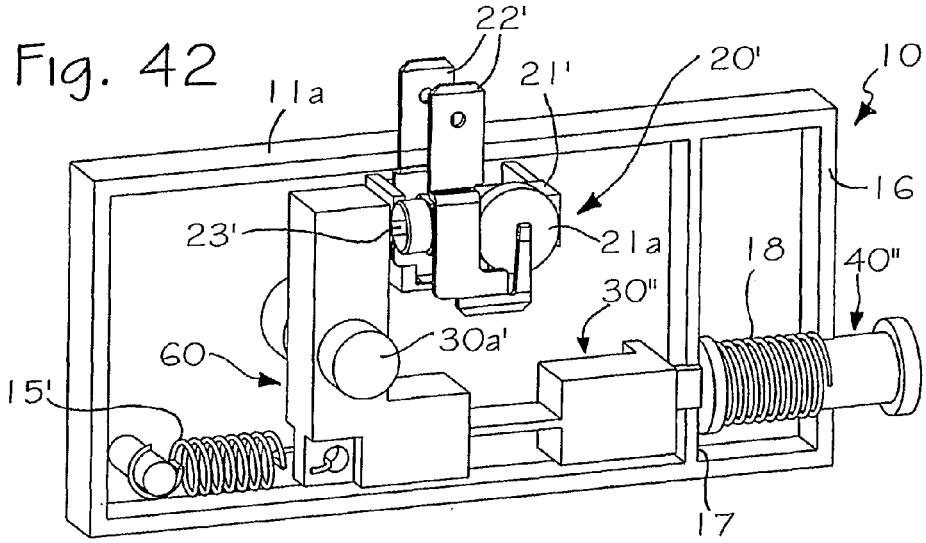
FIGS. 42 and 43 are partially sectioned perspective views of an actuation device according to the invention, in a third embodiment, in two different conditions.
Figure 43:
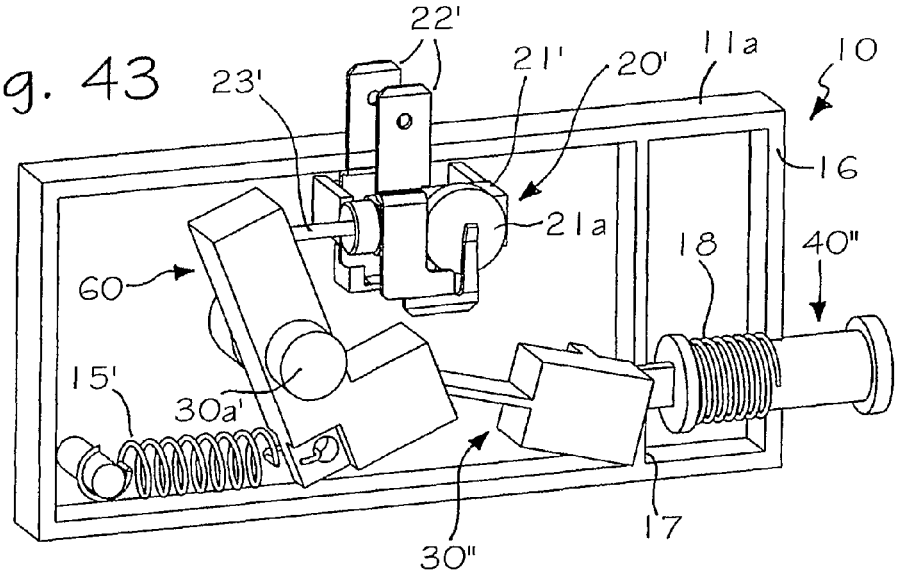

In the two embodiments previously described, the actuation device 10 is provided in such a way that the driving member 30, 30' will exert a pulling action on the driven member 40, 40'; the device could in any case be readily conceived for performing an actuation of an opposite type; a case of this sort is represented in FIGS. 42 and 43, which the device 10 is pre-arranged in order for the driving member, here designated by 30", to impart a thrust on the driven member, here designated by 40", instead of a pulling action; in this application, hence, the driven member 40 is linearly movable towards the outside of the casing 11.

Figure 44:
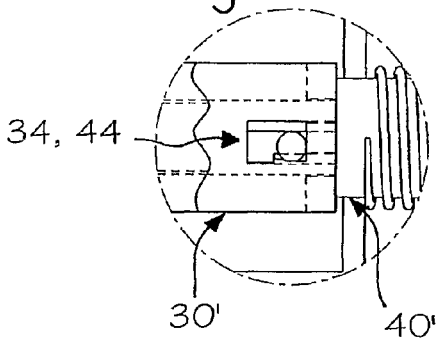
FIGS. 44 and 45 are schematic front views in partial cross section of a part of an actuation device according to FIG. 22 and of an actuation device according to FIG. 42, respectively.
Figure 45:
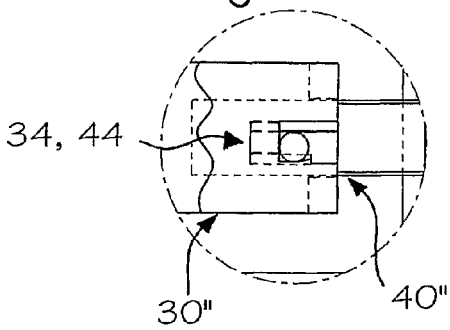

In practice, the third embodiment illustrated in FIGS. 42 and 43 is implemented using to a large extent components similar to those of the second embodiment (see, for example, FIG. 22), with the difference that in this case the actuator 20' is arranged for imparting upon the lever 60 an angular movement in a counterclockwise direction (as viewed in FIGS. 42, 43), and hence for producing both a thrust and a partial raising of the member 30", in the course of the various actuations, as is clearly visible in FIG. 43. Of course, for said purpose, the longitudinal orientation of the seats 34' and 44' of the members 30" and 40" will be opposite with respect to that of the second embodiment described previously; FIG. 44 illustrates schematically and in partial cross section just the area of coupling between the members 30', 40' of the device 10 of FIG. 22, whilst FIG. 45 illustrates the homologous area of the members 30" and 40" of the device of FIG. 42; from a comparison between said figures, it may be immediately noted how the longitudinal orientations of the seats 34', 44' in the two cases differ.

From the foregoing description there emerge clearly the characteristics and advantages of the present invention, which are principally represented by the compactness of the mechanism for coupling between the members of the actuation device, the simplicity of fabrication of its components, the substantial absence of mechanical wear between the interacting parts.

Figure 46:
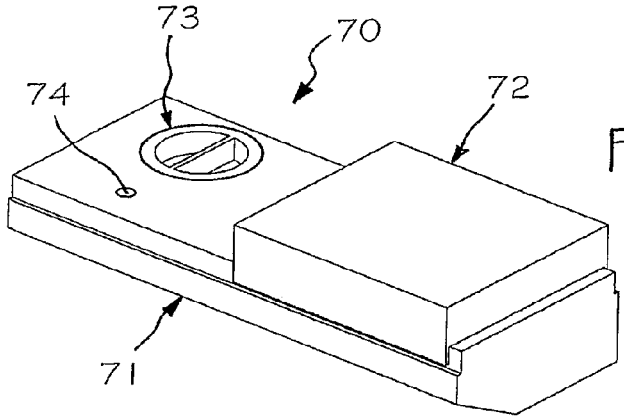
FIGS. 46 and 47 are perspective views of the front part and of the rear part of a dispenser of washing agents for a dishwasher, which integrates an actuation device according to the invention.
Figure 47:
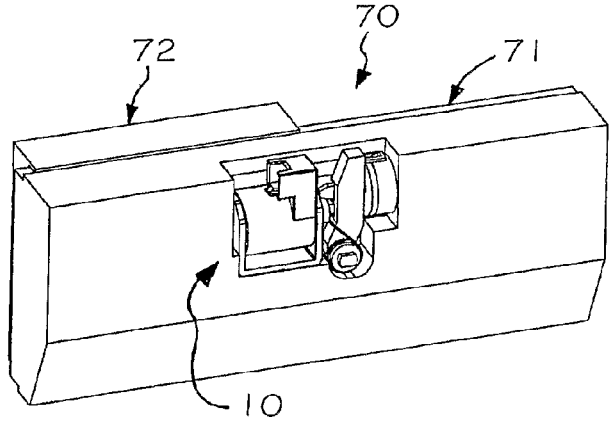
Figure 48:
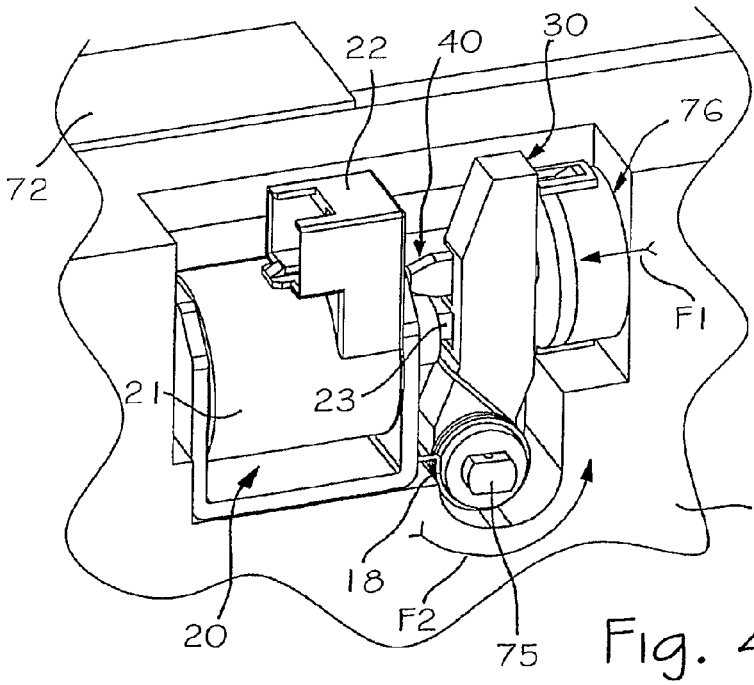
FIG. 48 is an enlarged detail of FIG. 47.

The invention has been previously described with reference to the use in combination with a detergent drawer of an extractable type for a washing machine, but it is clear that the device 10 can be used in other contexts. For example, the device 10 could be associated to a dispenser for detergents mounted on the door of a top-loaded washing machine, so as to exploit directly the typical movement of the door itself—horizontal when closed and vertical what open—to obtain resetting of the device according to the invention. The same may be said for the case of application of the invention on a dispenser of washing agents for a dishwasher, which is usually mounted on the front door of the latter. An example of application of this sort is shown in FIGS. 46, 47 and 48, where the reference number 70 designates the dispenser, having a main body 71 in the front part of which a compartment for containing the detergent is formed (not visible), functionally associated to which is a respective lid 72; in the case exemplified, the lid 72 is slidably mounted on the body 71 and is able to move between an opening position and a closing position, only the latter being represented in the figures. Formed within the body 71 is a tank for the liquid rinse aid, not visible, in communication both with an opening for loading provided with a removable plug, designated by 73, and with a supply opening 74.

The dispenser 70 is equipped with a hooking/releasing arrangement, provided for blocking the lid 72 in the closing position and then unblocking it, in order to enable it to be opened under the action of elastic means, when the detergent is to be delivered; the dispenser 70 is moreover provided with a valve arrangement, for control of delivery of the rinse aid. The aforesaid devices are of a conception known in the field and consequently they are not described herein, except as regards the parts of interest. As may be seen in FIG. 47 and, in greater detail, in FIG. 48, in the rear part of the body 71 of the dispenser 70 an actuation device 10 is provided, made substantially according to the first embodiment; from said figures, it may be noted how, for certain applications, the device according to the invention will not necessarily have to comprise a casing, it being sufficient to envisage a supporting structure on which the components of interest are mounted.

In the application illustrated (see, in particular, FIG. 48), the lever 30 does not present a respective pin-like portion, but is, instead, fitted directly to an end region of a shaft, designated by 75, which forms part of the aforesaid hooking/releasing arrangement of the lid 72; on the other side, the aforesaid valve arrangement for control of delivery of the rinse aid, designated by 76, is instead driven via the rod 40 of the device 10. The arrangement is such that, following upon a first actuation of the device 10 (i.e., a condition analogous to that of FIG. 20), the angular movement of the lever 30 produces rotation of the shaft 75, with consequent opening of the lid 72, and without the limited sliding of the rod 40 causing an actuation of the valve arrangement 76. During the second actuation of the device 10 (i.e., a condition analogous to that of FIG. 21), instead, the amount of the movement of the rod 40 will be such as to cause delivery of a dose of rinse aid by the valve arrangement 76. As mentioned previously, in this application, resetting of the system will be obtained by exploiting the movement of opening and closing of the door of the dishwasher.

With reference to the possible application illustrated in FIGS. 46-48, it is to be noted that the device 10 will be conceived in such a way that, following upon first actuation, the movement of the lever 30 will cause a sliding of the rod 40 that is not significant, or not sufficient to cause the desired actuation for the valve arrangement 76. The device 10 can in any case be conceived in such a way that, following upon first actuation of the actuator 20, the movement of the lever 30 will not be in effect transferred to the rod 40, i.e.,—in general terms—with the driven member 40 that remains substantially motionless; this may be readily obtained by proportioning suitably the seats 34, 44 and the ball 50.

It is clear that numerous variants are possible for the person skilled in the art of the dispenser described by way of example, without thereby departing from the scope of the invention as defined in the ensuing claims.

In accordance to a possible variant, the device 10 according to the invention is provided for being fixed or mounted in a position such that it remains constantly vertical (second embodiment) or almost vertical (first embodiment), or without variations of its plane of lie. In said variant, in order to cause passage of the ball 50 from the seat 44, 44' to the seat 34, 34', operatively associated to the device 10 is a magnetic element. In a possible embodiment, said magnetic element comprises an electromagnet, which can be actuated selectively via a suitable control system (for example, the timer of a washing machine or a dishwasher) in order to produce at the appropriate moment a magnetic field of suitable polarity to attract or else repel the ball 50 into the desired seat, respectively via a phenomenon of magnetic attraction or magnetic repulsion. The control system is, in this case, provided for generating the aforesaid magnetic field in the appropriate times and ways, and the ball 50, or the floating body of other form that performs the functions thereof, is made of a suitable material, preferably of a ferromagnetic type.

Another possibility is that of using a permanent magnet, associated to a component that selectively comes to occupy a position in the vicinity of the device 10, or rather of the area of intersection between the members 30, 30', 30" and 40, 40, 40". Purely by way of example, a permanent magnet of this sort could be associated to the lid 72 of a dishwasher dispenser, in a suitable position in order that, with the lid closed, the magnetic field will affect the area of intersection between the members 30 and 40. The system can be conceived in such a way that the magnet will generate a force of attraction or repulsion such as to force the ball 50 into the seat 34; consequently, following upon opening of the lid 72, with consequent moving away of the aforesaid magnetic field from the area of intersection between the members 30 and 40, the ball 50 will be able to pass from the seat 34 to the seat 44, in the ways described above; next, prior to starting of a new washing cycle, closing of the lid 72 will enable the magnetic field to be brought back into the area of interest, in order to cause passage of the ball 50 from the seat 44 to the seat 34, in order to reset the actuation system.

The invention may, of course, be applied also to fields other than that of electrical household appliances, mentioned herein only by way of example.

At least some of the elements described herein with reference to the various examples of embodiment of the invention may be present in a different number and arrangement; elements of different examples may possibly be combined together.

The invention claimed is:

1. An actuation device that comprises a driving member, a driven member, and actuator means, which can be operated to produce a movement of the driving member, where a first one of said members has a first seat in which there is operatively inserted, with possibility of relative movement, an engagement part of a second one of said members, characterized in that the second one of said members has a second seat, which, in at least one position of the actuation device at least partially faces the first seat of the first one of said members, and in that the actuation device further comprises at least one floating body, able to displace between the two seats when said seats at least partially face one another.

2. The device according to claim 1, wherein the driving member and the driven member, or else the respective seats, are arranged or configured such that at least one displacement of the floating body from one seat to the other occurs in a selective or controlled way, namely:

as a function of the mutual position assumed by respective portions of the seats themselves following upon an actuation of the actuator means, and hence following upon a relative displacement between the driving member and the driven member; and/or following upon a variation of the angular position of the device.

3. The device according to claim 1, wherein the driving member and the driven member, or else the respective seats, are arranged or configured such that, following upon an actuation of the actuator means:

with the floating body in the first seat, the driven member performs a first stroke, when the floating body is in the second seat, the driven member performs a second stroke, of a smaller amount as compared to the first stroke, or else remains substantially motionless.

4. The device according to claim 1, wherein the driving member and the driven member, or else the respective seats, are arranged or configured such that:

during an actuation of the device, with the floating body in the second seat, the engagement part can perform a maximum stroke within the first seat, in such a way as:

to cause a transfer by a first amount of the movement of the driving member to the driven member, or else to cause a non-significant transfer of the movement of the driving member to the driven member, or else not to cause a transfer of the movement of the driving member to the driven member;

during another actuation of the device, with the floating body in the first seat, the engagement part can perform only a reduced stroke within the first seat, in order to cause:

a transfer by a second amount of the movement of the driving member to the driven member, or else a significant transfer of the movement of the driving member to the driven member.

5. The device according to claim 1, wherein the first and second seats are shaped as a slot.

6. The device according to claim 5, wherein the slot has dimensions such as to be able to house the floating body completely and allow at least one displacement thereof according to a longitudinal extension of the slot itself.

7. The device according to claim 5, wherein each member comprises a region having a surface in correspondence of which the respective seat opens.

8. The device according to claim 7, wherein said surface of one member is arranged for co-operating in a sliding relationship with said surface of the other member.

9. The device according to claim 5, wherein the second seat has a variable depth, or has an inclined bottom surface.

10. The device according to claim 1, wherein the floating body has a substantially spheroidal shape.

11. The device according to claim 1, wherein at least one of said members is able to perform angular movements.

12. The device according to claim 1, wherein at least one of said members is able to perform linear movements.

13. The device according to claim 1, wherein the engagement part has a lateral surface that is located in the proximity, or forms a prolongation, of a longitudinal end surface of the second seat.

14. An actuation device system comprising a structure coupled to the device according to claim 1, wherein the structure is angularly movable between a reclined or lowered position and an upright or raised position, and in which the driving member and the driven member, or else the respective seats, are arranged or configured such that, with the floating body in the first seat, passage of the structure between the upright position and the reclined position causes passage by gravity of the floating body from the first seat to the second seat.

15. The device according to claim 1, wherein the driving member (30; 30'; 30") and the driven member (40; 40'; 40"), or else the respective seats (34, 44; 34', 44), are arranged or configured such that passage of the floating body (50) from the second seat (34; 34') to the first seat (44; 44') occurs by gravity, following upon an actuation of the actuator means (20; 20').

16. The device according to claim 1, wherein means are provided for generating a magnetic field suitable for causing, via magnetic attraction or repulsion, a displacement of the floating body.

17. The device according to claim 1, wherein the driving member is pre-arranged for generating a pulling action on the driven member.

18. The device according to claim 1, wherein the driving member is arranged for generating a thrust on the driven member.

19. The device according to claim 1, wherein the driving member controls a first mechanism and the driven member controls a second mechanism.

20. The device according to claim 1, wherein the driving member is articulated to an actuation element in such a way that a movement of the actuation element causes a roto-translational movement of the driving member.

21. A method for actuation of an actuation device that comprises a driving member, a driven member and actuator means, which can be operated to produce a movement of the driving member, where a first one of said members has a first seat in which there is operatively inserted, with possibility of relative movement, an engagement part of a second one of said members, the method being characterized by the following operations:

providing the second one of said members with a second seat, which, in at least one position of the actuation device, at least partially faces the first seat of the first one of said members;

providing a floating body, displaceable between the two seats, when the two seats at least partially face one another;

selectively causing displacement of the floating body between the two seats, in such a way that, following upon an actuation of the actuator means:

with the floating body in the first seat, the driven member performs a first stroke, and with the floating body in the second seat, the driven member performs a second stroke, of a smaller amount as compared to the first stroke, or else remains substantially motionless.

* * * * *